United States Patent [19]

Narita et al.

[11] 4,308,331

[45] Dec. 29, 1981

[54] SCREEN PHOTOSENSITIVE MEMBER AND ELECTROPHOTOGRAPHIC METHOD

[75] Inventors: Noboru Narita, Yokohama; Keiichi Murai, Abiko; Teruo Misumi, Toride, all of Japan

[73] Assignee: Canon Kabushiki Kaisha, Tokyo, Japan

[21] Appl. No.: 55,592

[22] Filed: Jul. 9, 1979

[30] Foreign Application Priority Data

Mar. 2, 1979 [JP] Japan ..... 54-24892
Mar. 2, 1979 [JP] Japan ..... 54-24893

[51] Int. Cl.[3] ..... G03G 13/044

[52] U.S. Cl. ..... 430/53; 430/68; 355/35 C

[58] Field of Search ..... 430/53, 68; 355/35 C

[56] References Cited

U.S. PATENT DOCUMENTS

| | | | |
|---|---|---|---|
| 3,824,010 | 7/1974 | Pressman | 430/68 |
| 3,986,871 | 10/1976 | Blades et al. | 430/68 |
| 4,046,466 | 9/1977 | Ando et al. | 430/53 |
| 4,092,160 | 5/1978 | Jackson et al. | 355/35 C |

FOREIGN PATENT DOCUMENTS

| | | |
|---|---|---|
| 48-13063 | 4/1973 | Japan . |
| 1480841 | 7/1977 | United Kingdom . |

*Primary Examiner*—Richard L. Schilling

*Assistant Examiner*—John L. Goodrow

*Attorney, Agent, or Firm*—Fitzpatrick, Cella, Harper & Scinto

[57] ABSTRACT

The invention concerns a screen photosensitive member, and an electrophotographic method using such screen photosensitive member, and relates to improvement in the screen constructed with an electrically conductive member, a photoconductive layer provided on the electrically conductive member, and a surface insulative layer constituting the screen surface at the side opposite to at least a modulating corona source. More particularly, the screen according to the present invention is further provided, at the side of the modulating corona source, with a potential holding layer which holds thereon corona ions applied to it and maintains the surface of the screen at the side of the modulating corona source at a predetermined potential.

By the use of the screen of the present invention, it becomes possible to improve the potential of a latent image formed on the screen and, moreover, to effect ion modulation repeatedly from one and the same latent image formed on the screen owing to the capability of the potential holding layer to maintain the potential on one surface side of the screen at a predetermined level and to absorb due to the characteristic of this potential holding layer, excessive charge for the modulation as applied to the screen.

14 Claims, 40 Drawing Figures

SCREEN PHOTOSENSITIVE MEMBER AND ELECTROPHOTOGRAPHIC METHOD

BACKGROUND OF THE INVENTION

1. Field of the Invention

This invention relates to an electrophotographic technique of forming an image by modulating ion current through an electric field formed on a screen photosensitive member.

2. Description of Prior Arts

From U.S. Pat. No. 3,582,206, U.S. Pat. No. 3,645,614 and others, there has already been known an electrophotographic method, by which a primary latent image following an original image is formed on a screen photosensitive member having a multitude of fine openings (such photosensitive member will hereinafter be called simply "screen"), and this latent image is used for modulating corona ion current to form a secondary latent image on a chargeable surface, thereby reproducing the original image.

The screen photosensitive member as disclosed in British Patent specification No. 1,480,841 and U.S. Patent Application Ser. No. 771,309 and for use in such electrophotographic method as disclosed in the abovementioned U.S. Patents is of such a construction that it has an electrically conductive substrate, a photoconductive layer provided on the electrically conductive substrate, a surface insulative layer on this photoconductive layer, and a further electrically conductive member at the side of a modulating corona source.

The effects to be derived from the abovementioned laminar structure of the screen are as follows:

(1) The latent imge charge as formed on the screen is less attenuable with lapse of time and passage of ion, because the primary latent image is formed on the insulative layer; and (2) Owing to the presence of the electrically conductive member at the side of the modulating corona source, excessive or unnecessary modulating corona flows out of the electrically conductive member at the time of modulation, and such excessive corona ion at the modulation does in no way have an adverse effect on to the primary latent image.

On account of such effect derived from the presence of the surface insulative layer and electrically conductive member at the side of the modulation ion source, it is possible to perform retention copying which modulates ion current over many repeated times with one and the same primary latent image.

In the following, detailed explanations will be given in reference to FIGS. 1 to 5 of the accompanying drawing as to this known screen disclosed in the abovementioned British patent specification and U.S. Pat. application as well as examples of the latent image formation using such conventional screen.

It should be noted that the materials used for the screen will be omitted from the explanations.

FIG. 1 is a schematic diagram of a partially enlarged cross-section of the screen disclosed in the abovementioned prior patent and application. In the illustration, the screen 1 is of such a construction that the photoconductive layer 3 and the surface insulative layer 4 are laminated on the electrically conductive member 2 having a multitude of fine openings. In the following explanations, this electrically conductive member 2 has such a characteristic that permits electrons to be injected into the photoconductive layer even at a dark portion of the image. More concretely, the photoconductive layer 3 is composed of cadmium sulfide (CdS), zinc oxide (ZnO), and other like semiconductors with electrons as the principal carrier.

FIGS. 2 to 5 explain the primary and secondary latent image forming processes, in which FIG. 2 illustrates the primary voltage application step, FIG. 3 the secondary voltage application step, FIG. 4 the overall irradiation step, and FIG. 5 the electrostatic latent image forming step, wherein ion current is modulated by the primary electrostatic latent image formed on the screen by the foregoing steps.

FIG. 2 shows the primary voltage application step, wherein the screen 1 is uniformly charged in the positive (+) polarity by a corona discharger as the voltage application means. In the illustration, a reference numeral 5 designates the corona discharger. By the abovementioned electric charging, the positive charge is accumulated on the surface of the insulative layer 4. On account of this charge, a negative charge layer which is in the opposite polarity of the above-mentioned charge is formed in the vicinity of the insulative layer 4 in the photoconductive layer 3. Incidentally, when an interface between the photoconductive layer 3 and the electrically conductive member 2 as well as the photoconductive layer per se are of such a property that majority carriers are injected thereinto, but minority carrier are not, and the screen as a whole possesses a rectification property, it is possible to form the charge layer in the vicinity of the insulative layer 4 in the photoconductive layer 3 even at the dark portion by the carrier injection as mentioned above. In the screen having no rectification property, or no capability of forming the abovementioned charge layer by application of the primary voltage, satisfactory result will be obtained with the charging method as described in U.S. Pat. No. 2,955,938, wherein the insulative layer is charged at a bright place.

FIG. 3 illustrates a result of simultaneously effecting both image irradiation and secondary voltage application step on the screen 1 which has been subjected to the primary voltage application step. In the drawing, a number 6 refers to an image original, wherein the side D denotes a dark portion, the side L a bright portion. Arrows 7 indicate light from a light source (not shown). A numeral 8 refers to a corona discharger for the secondary voltage application. In the illustrated case, the screen is charged in the opposite polarity by the corona discharge from a corona wire 8 applied with a d.c. voltage in the negative polarity so that the surface potential of the insulative layer 4 may be in the negative polarity.

When the surface potential of the insulative layer 4 takes the negative polarity as mentioned above, the substance in the photoconductive layer 3 at the bright portion L becomes electrically conductive due to the image irradiation with the consequence that the surface potential of the insulative layer 4 assumes the negative polarity. On the other hand, however, the surface charger of the insulative member 4 at the dark side D therof remains in the positive polarity because of the negative charge layer existing in the photoconductive layer 3 at the side of the insulative layer 4.

Considering, here, the polarity changing speed in the potential on the insulative layer 4 of the screen 1 in the abovementioned step, the portion where the insulative layer 4 faces the corona discharger 8 (the front surface side) changes the most quickly, while the lateral surface part and its vicinity which surround this facing portion and constitutes the opening of the screen changes after this front surface part. Accordingly, at the image irradiating section, the potential of the screen, at its side where the electrically conductive member 2 is exposed (the rear surface side), corresponds to the potential on the electrically conductive member 2, and the potential gradually increases from this rear surface side to the front surface side.

FIG. 4 shows the result of effecting a uniform overall light exposure as the overall irradiation step, to the screen 1 which has been subjected to the image irradiation and the secondary voltage application step. In the drawing, arrows 9 denote a uniform light beam from a light source (not shown). By this overall irradiation, the potential at the dark side D of the screen 1 changes to a potential which is proportional to the charge quantity on the surface of the insulating layer 4.

As the result, there exist a relationship to be represented by the following equation (1) among a latent image contrast Vc at the bright and dark portions of the screen 1, a surface potential $V_1$ due to the primary voltage application step, and a surface potential $V_2$ due to the secondary voltage application step.

$$Vc=[Ci/(Ci+Cp)](V_1-V_2) \quad (1)$$

(where: Ci denotes an electrostatic capacitance of the surface insulative layer 4; and Cp and electrostatic capacitance of the photoconductive layer).

In order to increase the electrostatic contrast of the primary latent image in the above equation (1), there may be contemplated the following:

(a) a method, in which the surface potential $V_1$ is elevated by increasing the primary voltage, in accordance with which the latent image potential at the dark portion is elevated; and (b) a method, in which the secondary voltage is made as low as possible, in accordance with which the latent image potential at the bright portion is lowered.

In the above method (a), there is a limit to the increase in the primary voltage, since the method is operated generally in an almost critical state with the consequence that excessive electric charge would cause spark discharge or pin holes due to dielectric breakdown to apprehensively impair the screen. On the other hand, the electrostatic contrast can be increased by the method (b), that is in the conventional surface potential curve ($V_1$-$V_2$-$V_D$, $V_L$) as shown in FIG. 6 with a solid line, the negative voltage at the time of the secondary voltage application is raised to lower $V_2$ to $V'_2$ in the surface potential curve after the secondary voltage application as shown by a dash line, whereby the electrostatic contrast Vc ($|V_D-V_L|$) to be finally obtained is considerably increases to Vc' ($|Vc'-V_L'|$).

FIG. 5 shows a state, wherein the ion current is modulated by the primary latent image to form the secondary latent image on a recording medium. In the drawing, a numeral 10 refers to a corona wire, 11 an opposite electrode member, 12 a chargeable surface such as a reproduction paper, on the surface of which the secondary latent image is formed. Numerals 13, 14 denote power source sections, by which an electric field is formed in the flowing direction of the corona ion between the corona wire and the reproduction paper 12. The reproduction paper 12 is disposed closer to the side where the insulative member 4 of the screen 1 faces, and the flow of ion is applied to the reproduction paper 12 from the corona wire 10 disposed with the screen 1 interposed between the wire and the paper. In this instance, there acts on the screen 1 an electric field due to the primary latent image; that is, at the bright portion of the image, the field acts to block the negative flow of ion as shown in solid lines $\alpha$ acts on the screen, while at the dark portion of the image, the field accelerates the flow of ion as shown in solid lines $\alpha$. By these electric fields, the secondary latent image is formed on the reproduction paper 12 in the form of the positive image of the original.

Here, it is assumed that the critical value of the field $\alpha$ to block passage of the negative corona ion at the screen openings at the time of the modulation is given as "$\alpha$ critical" (hereinafter abbreviated as "$\alpha$ crit."), this blocking field $\alpha$ crit. is determined by the diameter and depth of the opening, and, further, by a potential difference between the electrically conductive member 2 and the opposite electrode member 11, whereby the field to be formed by the potential difference V between the front and rear surfaces of the screen becomes a yardstick for it. Moreover, if it is assumed that the potential difference V between the front and rear surfaces of the screen, when the critical field $\alpha$ crit. is formed by use of the screen 1, is "V critical" (hereinafter abbreviated as "Vcrit."), the surface potential of the screen, when the field $\alpha$ crit. is formed, becomes inevitably Vcrit., because the electrically conductive member 2 at the rear surface of the screen 1 is exposed outside, hence its surface potential is zero. Accordingly, when the screen 1 is used, passage of the corona ion in a particular polarity through the screen openings is entirely blocked as soon as the surface potential of the screen becomes below Vcrit.

Referring now to FIG. 7, explanations will be given as to the relationship between the electrostatic contrast Vc in the primary latent image using the abovementioned screen 1 and the electrostatic contrast virtually acting in the secondary latent image forming step.

Assume that the critical blocking field $\alpha$ crit. corresponds to the surface potential Vcrit. of the screen 1:

(i) if the surface potential $V_L$ of the screen corresponding to the bright portion of the image is set at the zero potential which is higher than the surface potential Vcrit., the curve (dot-and-dash line) follows $V_1$-$V_2$-$V_D$, $V_L$, and the potential difference becomes Vc;

(ii) if the surface potential $V_L$ of the screen corresponding to the bright portion of the image is set at the same value as the surface potential Vcrit., the curve (solid line) follows $V_1$-$V_2'$-$V_D'$, $V_L'$, and the potential differences becomes Vc'; and (iii) if the surface potential $V_L$ of the screen corresponding to the bright portion of the image is set at a value lower than the surface potential Vcrit by performing intense application of the secondary voltage in the opposite polarity as mentioned with respect to FIG. 6, the curve (dash line) follows $V_1$-$V_2''$-$V_D''$, $V_L''$.

In the abovementioned three situations (i), (ii), and (iii), the highest primary latent image contrast is obtained when the relationship of $Vc<Vc'<Vc''$ is established from FIG. 7 and the above equation (1), i.e., the case of above (iii). With the surface potential being below Vcrit., the corona ion does not pass through the screen openings, hence no contribution to the secondary latent image formation. As the result of this, the electrostatic contrast becomes substantially $V_D''$-Vcrit. Accordingly, of the primary latent images, those having the surface potential in a range of from Vcrit. to $V_L''$ are not turned to the secondary latent image. Particularly, the image on the bright portion thereof is not reproduced, hence no reproduced copy, in which the original image has been faithfully reproduced, cannot be obtained. In contrast to this, the above case (i) is lower than the case (ii) in its primary electrostatic latent image contrast. When it cannot be expected that the primary voltage is made higher than $V_1$, the primary electrostatic latent image contrast becomes the maximum by setting of the case (ii). In other words, the electrostatic contrast of the primary latent image to faithfully reproduce the original image in the abovementioned steps by the use of the screen 1 becomes the maximum when the surface potential at the bright portion of the image is set at Vcrit. as is the case with above (ii).

In the conventional screen, the critical blocking field α crit. is set by the potential of the primary latent image at the bright portion of the image, and the method as in the above case (iii) in FIG. 7 could not be used, because faithful reproduction of the original image could not be attained.

SUMMARY OF THE INVENTION

The object of the present invention resides in a solution of various problems in the conventional techniques as mentioned in the foregoing. More specifically, it is an object of the present invention to provide a screen capable of maintaining the potential of the primary latent image at the bright portion of the image below the potential constituting α crit., and of reproducing the electrostatic contrast at the bright and dark portions at its maximum degree, and a latent image forming method using such screen. That is, the present invention attempts to improve the capability of the retention copying by causing the modulating corona ion to pass through almost the entire region of the screen where the electrostatic contrast is Vc'' as in the case (iii) in FIG. 7, effecting the secondary latent image formation rich in tonality, and, at the same time, enabling formation of the primary latent image at high potential.

In order to attain the abovementioned object, the screen according to the present invention is essentially composed of an electrically conductive member, a photoconductive layer provided on this electrically conductive member, a surface insulative layer constituting a surface of the photosensitive member on the side opposite to a modulating corona source and holding thereon a latent image charge, and a potential holding (or retaining) layer provided on the surface of the photosensitive member at the side of the modulating corona source. The surface insulative layer and the potential holding layer may be constructed either separately or integrally. As one modification, the potential holding layer may be so constructed that the photoconductive layer inside the surface insulative layer be present to the side of the modulating corona source. Effective electrical resistance of the potential holding layer may range from $10^7$ to $10^{10}$ $cm^2$-ohm, or preferably from $10^8$ to $10^9$ $cm^2$-ohm, in terms of a product of the volume resistivity of the material to be used and the thickness of the potential holding layer. The time constant of the potential holding layer may be set at 100 sec. or below, or preferably 50 sec. or below for good result. As for the rate of screen opening (or open area ratio), it may be from 5 to 50%, or more preferably 10 to 45%.

The latent image formation using such screen as mentioned above may be done in the following manner:

(1) the primary latent image is formed on the photosensitive member through, at least, the following steps:

(a) uniform changing of the surface insulative layer in a particular polarity;

(b) irradiation of dark and bright patterns of an image onto the photosensitive member; and (c) uniform charging of the photosensitive member in a polarity opposite to the charge polarity in the step (a), this step being carried out simultaneously with, or subsequent to, the step (b);

(2) thereafter, the modulating corona is applied to the potential holding layer from the side of this potential holding layer which is maintained at a predetermined potential; and (3) an image is formed on a chargeable surface by the modulated ion.

Incidentally, the method of maintaining the potential holding layer at a predetermined potential may be done by charging the potential holding layer with corona ions by application of the modulating corona ion, or by application of a bias voltage to the potential holding layer.

It is to be noted that the abovementioned numerical figures are those under applied field at the time of the image formation with thickness of the potential holding layer which is actually formed on the screen.

DETAILED DESCRIPTION OF PREFERRED EMBODIMENTS

Figure 1:
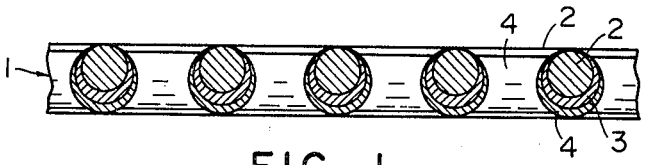
FIG. 1 shows an enlarge cross-sectional view of a part of a conventional screen.

In the following, preferred embodiments of the present invention will further be detailed in reference to various figures of the drawing.

Figure 8:
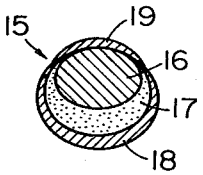
FIG. 8 is an enlarged cross-section of the screen according to the present invention.

FIG. 8 is an enlarged cross-section of one embodiment of the screen according to the present invention, in which a potential holding layer is provided at a portion of the screen 1 shown in FIG. 1 where the electrically conductive member 2 is exposed. In more detail, the screen 15 in FIG. 8 is so constructed that a photoconductive layer 17 and a surface insulative layer 18 are laminated on the surface of this electrically conductive member 16 as the substrate in a manner to expose a part of the electrically conductive member 16 outside, and the potential holding layer 19 is provided on this exposed rear surface of the electrically conductive member 16.

For the material of the electrically conductive member 16 constituting the screen 15, there may be used a flat plate of good electrically conductive substances such as stainless steel, copper, aluminum, tin, and other metals. Such flat plate is provided with a multitude of fine openings therein by an etching process. Alternatively, there may be used a plate processed by electroforming or a net made of thin wire of the abovementioned metals. It is further possible to use a screen manufactured from high polymeric material or inorganic insulative substance, on the surface of which electrically conductive substance is coated. For the purpose of general office reproduction, this electrically conductive member 16 is required to have a mesh size in a range of from 100 to 400 meshes from the standpoint of necessary image resolution. In further consideration of the material strength and rate of screen opening, a preferred and appropriate mesh size thereof may range from 200 to 300 meshes.

For the photoconductive layer 17, there may be used sulfur (S), selenium (Se), lead oxide (PbO), and alloys and intermetallic compounds containing sulfur, selenium, tellurium (Te), arsenic (As), lead (Pb), etc. These substances are evaporatively deposited on the electrically conductive member to form the photoconductive layer. When the sputtering method is used, photoconductive substance of high melting points such as zinc oxide (ZnO), cadmium sulfide (CdS), titanium oxide ($TiO_2$), and so forth may be deposited as the photoconductive layer. When the spray coating method is used, there may be employed organic substances such as polyvinyl carbazole (PVCz), anthracene, phthalocyanine, etc., or such organic substances which have been subjected to color-sensitization and Louis acid sensitization, or a mixture of these organic substances and insulative binders. Further, mixtures of those inorganic photoconductive substances such as ZnO, CdS, $TiO_2$, PbO, etc. and insulative binders are suitable for this spray-coating method. The insulative binders for this purpose are those organic insulative substance and inorganic substance such as glass which are used for the formation of the surface insulative layer to be mentioned hereinbelow. Thickness of the photoconductive layer 17 to be provided on the electrically conductive member 16 by the abovementioned means depends upon the kind and characteristics of the photoconductive substance to be used. In general, the maximum thickness of from 15 to 80 microns or so is proper.

For the material of the surface insulative layer 18, those materials having good charge sustaining characteristic at high resistance and being transparent to light irradiation at the light irradiation step should be used, although they are not necessarily excellent in their wear-resistant property. The materials satisfying the abovementioned requirements are: resins such as polyethylene, polypropylene, polystyrene, polyvinyl chloride, polyvinyl acetate, etc.; acryl resin; polycarbonate resin; silicon resin; fluorine resin; epoxy resin; diarylphthalate resin; phenoxy resin; vinylidene fluoride resin; parylene; and so forth. The layer is formed by various methods such as spray coating method, immersion method, roller coating method, evaporative deposition, sputtering, and others.

Thickness of the surface insulative layer 18 to be formed on the photoconductive layer 17 by the abovementioned expedient is determined in relation to thickness of the photoconductive layer 17, the rate of screen opening, and other factors. The potential holding layer 19 may be made of the same material as that of the abovementioned surface insulating layer 18. The method of forming this potential holding layer 19 may also be the same as that of the surface insulating layer 18.

Thickness of the potential holding layer 19 to be formed at the side of the modulating ion source of the screen by the abovementioned expedient is determined in consideration of the electrophotographic characteristic to be obtained by the photoconductive layer 17 and the surface insulative layer 18 formed on the rear surface of the screen, and the electrical resistance and electrostatic capacitance of the material to be used for the layer. As to the method for forming the potential holding layer 19, there may be adopted various methods such as, for example, a method, wherein the photoconductive layer 17 and the surface insulative layer 18 are formed on the electrically conductive member 16, after which the potential holding layer is formed on the opposite surface of these layers 17 and 18; a method, wherein the potential holding layer 19 is formed simultaneously with formation of the surface insulative layer 18; a method, wherein an insulating layer is formed on one or both surface sides of the electrically conductive member 16, after which the photoconductive layer 17 and the surface insulating layer 18 are formed; and other methods. It is noted that the potential holding layer 19 should not always be transparent to the irradiating light beam.

The potential holding layer 19 is for maintaining the screen at a predetermined potential level, as will be described in detail hereinafter. It can be made of the same material as those to be used for the surface insulative layer 18 such as organic and inorganic insulative substances. The other materials suitable for the potential holding layer are: electrically conductive polymers (quarternary ammonium salt), water soluble resins (polyvinyl alcohol, gelatin), various kinds of electrically conductive particles (carbon powder, metal powder, etc.) dispersed in a binder, various kinds of metal oxides, etc. made into a paint form, and a mixture of electrically conductive particles of semiconductive material (as the shaping material) and insulative binders. For the formation of the potential holding layer 19, there may be used various methods such as evaporative deposition, sputtering, alternating current cathode sputtering, spray-coating, immersion-coating, and roll-coating. More concretely, there are three ways of forming the potential holding layer 19, i.e., (1) the potential holding layer is first formed in a manner to cover one or both surface sides of the electrically conductive member 16 as well as the entire substrate, after which the photoconductive layer 17 and the surface insulative layer 18 are formed thereon; (2) the potential holding layer is formed simultaneously with formation of the surface insulative layer 18; (3) the photoconductive layer 17 and the surface insulative layer 18 are first formed. Any of these three ways may produce the same results. The potential holding layer 19 is not required to cover the entire surface of the electrically conductive member exposed at the rear surface. Even if the electrically conductive member is partially exposed, the self-bias effect (to be described later) can be exhibited. Also, in particular, when the potential holding layer is brought to a predetermined potential level by charging this layer with the modulating corona, the electrical resistance of the potential holding layer, in its state of actual use and depending on the abovementioned materials to be used and the layer forming method, may be set in a range of from $10^7$ to $10^{10}$ $cm^2$-ohm, or preferably from $10^8$ to $10^9$ $cm^2$-ohm, in terms of a product of the volume resistivity of the material used and thickness of the potential holding layer. Also, a time constant of the potential holding layer is set in a value of 100 sec. or below, or preferably 50 sec. or below. By constructing the potential holding layer with the abovementioned values, the self-bias effect can be utilized most effectively, whereby the primary electrostatic latent image having high electrostatic contrast between the bright and dark portion can be obtained.

Figure 9:
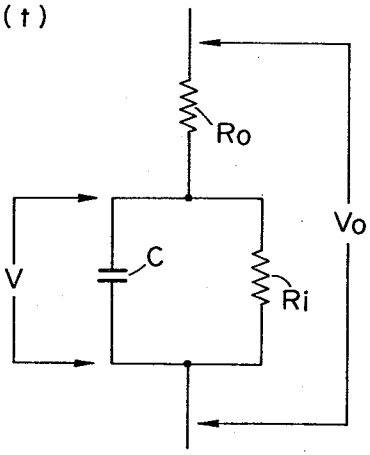
FIG. 9 shows an equivalent circuit diagram of a potential holding layer.

Explaining in more detail about the range of the electrical resistance value ($cm^2$-ohm) in reference to FIG. 9 which shows an equivalent circuit diagram of the potential holding layer section of the screen according to the present invention, a reference symbol Ro designates a discharge resistance (ohm), C an electrostatic capacitance of the potential holding layer, Ri an insulative resistance (ohm) of the potential holding layer, Vo a corona current voltage (v) of the modulating corona discharger, and V a charge potential (v) due to charging of the potential holding layer. In general, when the ion current is modulated by a screen of a size of a few hundreds meshes, the value of Vo is approximately 4,000 v, and the value of Ro is $10^9$ ohms or so (provided that the total current is 5 to 8 $\mu$A per 1 cm in length of the corona discharger). It has been experimentally varified that the charge potential V of the potential holding layer should preferably be set in a range of from 10 to 100 v in consideration of a thickness of the layer to always charge it at a constant potential and an area where the potential holding layer can be formed. In addition, the insulative resistance Ri is set at $2.5\times10^6$ to $2.5\times10^7$ ohms when the rotational speed of the screen at the time of the modulation is as fast as 40 cm/sec.. If the layer thickness is set at t [cm] with the volume resistivity being $\rho[\Omega\cdot cm]$, $\rho t[cm^2\cdot\Omega]=40$ Ri from $Ri=\rho(t/40)$, hence $\rho t$ takes a value of $10^8$ to $10^9[cm^2\cdot\Omega]$.

Figure 7:
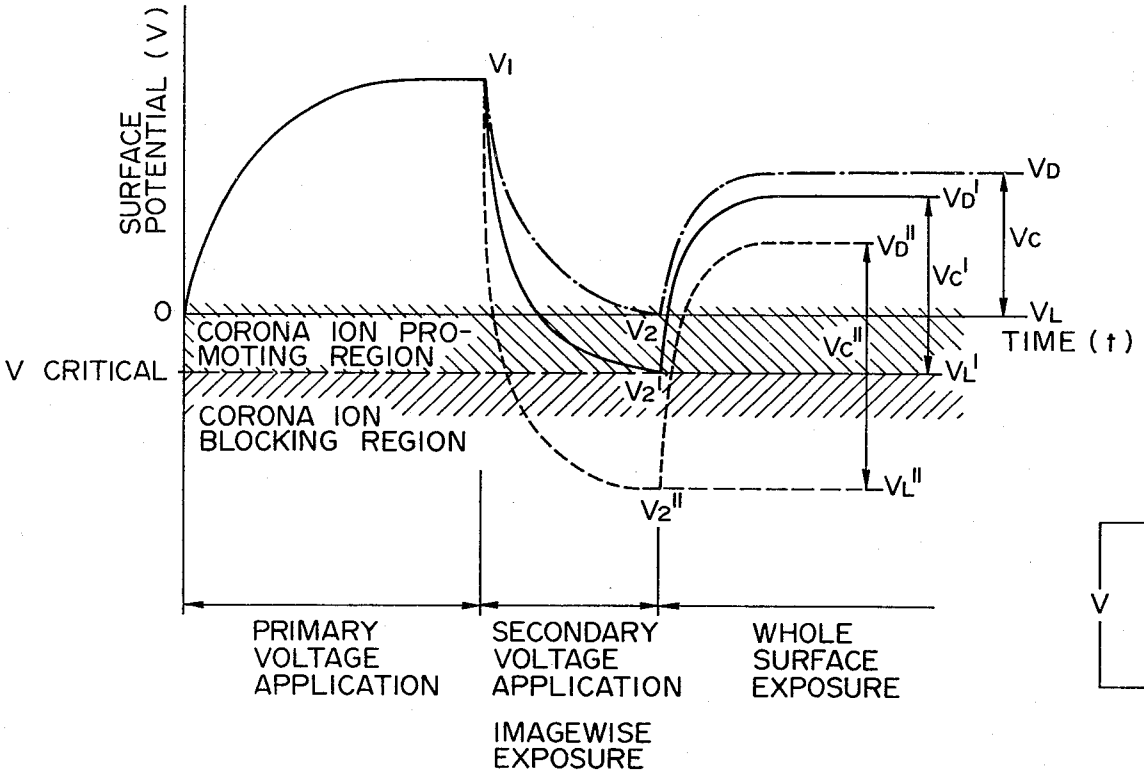

The present invention, which utilizes the above-described screen, makes it possible to lower the value of Vcrit. referred to in FIG. 7 in relation to the primary latent image potential at the bright potential side of the screen, thereby reproducing, as the secondary latent image, the entire region of the electrostatic contrast between $V''_D$ and $V_L''$ which constitute the potential contrast of the primary latent image at the bright and dark portions. In other words, the potential holding layer 19 of the screen 15 shown in FIG. 8 is charged to a predetermined potential by the modulating corona discharger. Thus, for example, when blocking the ion current with a potential difference of 50 v between the front and rear surfaces of the screen, the surface potential at the rear surface side of the conventional screen 1 shown in FIG. 1 becomes zero, since the electrically conductive member 2 at this portion is exposed outside. When the surface insulative layer is charged to −50 v, the potential difference becomes 50 v to thereby form the critical blocking field $\alpha$ crit., and the charge voltage −50 v becomes Vcrit., whereby, even when the screen is charged to −50 v, all the charge operates as the blocking field. In other words, the latent image potential at the side of the blocking field on the screen is regulated with the result that the electrostatic contrasts $V_D$ and $V_L$ are set at a potential difference between the above-mentioned Vcrit. and $V_D$.

However, the present invention solves this problem of restriction to the electrostatic contrast by means of the potential holding layer 19, the principle of which resides in that the potential holding layer 19 is charged by the modulating corona, and the critical blocking field $\alpha$ crit. is set by the potential on this potential holding layer 19 due to the corona charging and the primary latent image potential on the screen surface. For example, when the critical blocking field is assumed to be 50 v same as above, the potential difference between both front and rear surfaces of the screen is 50 v, even when the front surface of the screen is charged to −150 v with the potential holding layer 19 being charged to −100 v at the time of the modulation. In other words, the latent image potential at the bright portion of the screen is −150 v, and only the blocking field of 50 v remains at the opening of the screen. That is, the screen of the present invention functions to shift the value of Vcrit. substantially to −150 v which was, in the conventional screen, −50 v.

Supplementing the above explanations for the principle in reference to FIG. 7, the conventional screen forms the primary latent image with the surface potential as shown by the solid line; however, the screen according to the present invention makes it possible to form the primary latent image with a surface potential as shown by the dash line by shifting the value of Vcrit. in the negative direction, and also to reproduce the entire region where the potential difference is Vc'' as the secondary latent image by lowering the value of Vcrit. to $V_2''$.

Figure 10:
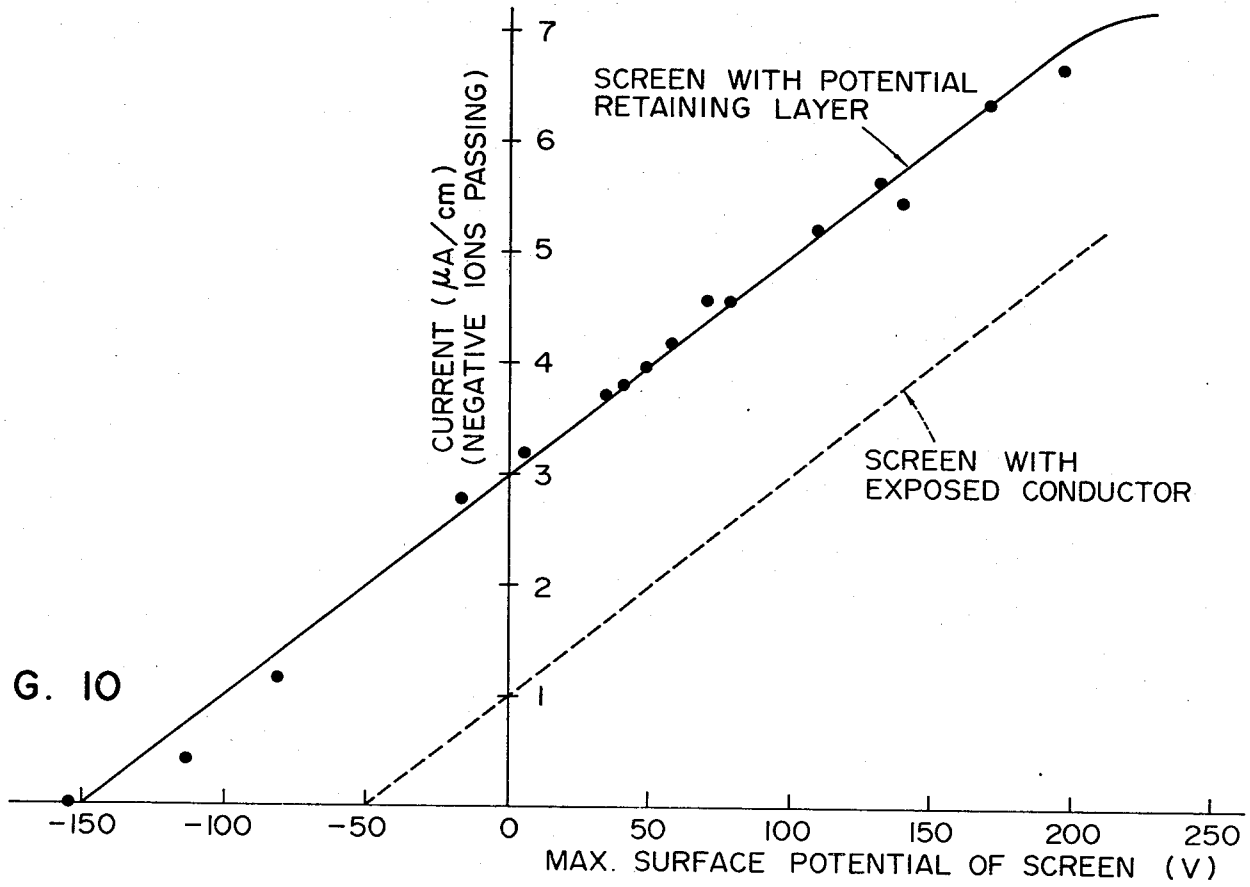
FIG. 10 is a graphical representation showing a relationship between the surface potential and current passing quantity.

FIG. 10 is a comparative graphical representation showing the passing quantity of the modulating corona ion when the potential holding layer is provided at the modulating side of the screen having the rate of opening of 22% (solid line) and the passing quantity when no such layer is provided. As the unitary conditions, the polarity of the modulating corona ion is the negative, and the screens used are those shown in FIGS. 1 and 8. Explaining now the graphical representation, in case the potential holding layer is not provided, the electrically conductive member in FIG. 1 is grounded to be at zero potential, on account of which, when the surface potential is higher than 0 volt, an accelerating electric field acts to pass the ion, but when the surface potential becomes 0 volt, the ion current passes due to the potential difference between the screen and the opposite electrode member. Further, when the surface potential becomes −50 volts, there is created the blocking field due to the potential difference of 50 volts between the electrically conductive member at zero volt and the surface potential, whereby the passage of the ion is completely blocked and the ion current becomes unable to pass.

In contrast to the above, where the potential holding layer is provided, the layer is charged to −100 volts at the time instant when the surface potential becomes −150 volts. On account of this, there occurs the potential difference of 50 volts between −100 volts and −150 volts, whereby the blocking field is created to hinder passage of the ion current in its entirety. Further, as is apparent from the graph, when comparison is made between the case, in which the surface potential of 100 volts is formed on the conventional exposed type screen and a case, in which a latent image of 100 volts is formed on the screen provided with the potential holding layer, the screen of the present invention having thereon the potential holding layer is able to pass more quantity of ion current than in the conventional screen, by 2 μA/cm.

In the following, explanations will be given as to the latent image forming process steps shown in FIGS. 2 to 5 in case they are applied to the present invention. A particular point of difference in this case from the conventional process is that the electric charging in the opposite polarity for the secondary voltage application is done more intensely than for the primary voltage application, in order to increase the electrostatic contrast Vc, whereby the primary latent image as shown by the dash line in FIG. 7 can be formed.

Figure 11:
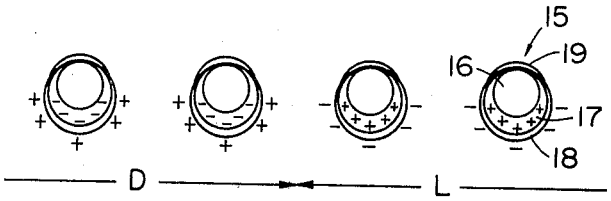
FIG. 11 is an explanatory diagram of the primary latent image formed on the screen shown in FIG. 8.

FIG. 11 shows a state of the electric charge after formation of the primary latent image on the screen 15. Observing efficiency of the charge adherence on the screen 15 of the present invention (the actually adhered charge quantity/total quantity of applied charge), it is seen that better result has accrued in comparison with the type where the electrically conductive member 2 is exposed on the rear surface of the screen 1 as in the conventional one. The reason for this is considered to be that, since the entire surface of the screen is covered with the insulative layer, there is caused no outflow of the charge from any portion of the screen.

Figure 12:
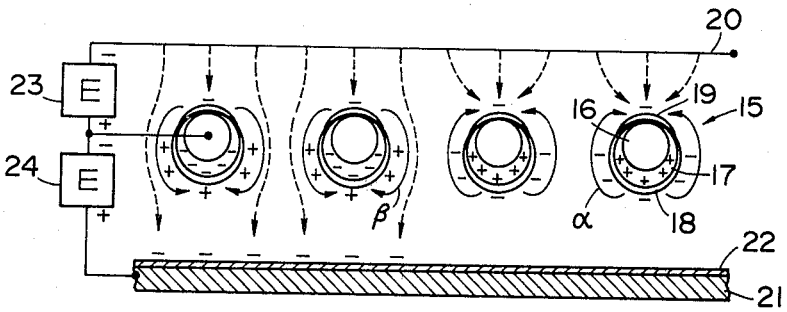
FIG. 12 is an explanatory diagram for the modulating step.

FIG. 12 illustrates the modulating step, wherein a reference numeral 20 designates a corona wire for the modulating corona discharger, 21 an opposite electrode of the corona wire, 22 a chargeable surface on the opposite electrode, and 23, 24 power sources for the corona wire 20 and for biassing, respectively. In this illustrated modulating step, there is created, at the dark portion D of the screen, an electric field as indicated by solid lines $\beta$ which directs from the rear surface to the front surface of the screen. This field $\beta$ has a function of accelerating the negative ion. Here, attention should be paid to the fact that the potential holding layer 19 on the rear surface of the screen is charged in the negative polarity by the modulating ion, as the consequence of which the screen has just the opposite polarities between its front and rear surfaces, and the screen has more intense accelerating field $\beta$ than in the type where the electrically conductive member is exposed to the modulating side as in the conventional screen.

On the other hand, there is created, at the bright portion L of the screen, an electric field as indicated by solid lines which direct from the front surface to the rear surface of the screen, by which passage of the modulating corona ion through the screen opening is blocked. The excessive corona ion which has been blocked its passage, therefore, flows into the electrically conductive member 16 through the potential holding layer 19, on account of which there is caused no maleffect to the screen, such as attenuation of the primary latent image, etc.. Further, in this case, the potential holding layer is maintained at a definite negative potential at the bright portion of the screen as at the dark portion thereof. Such function of maintaining the potential on the potential holding layer 19 at a certain definite value without applying a bias voltage is called "self-bias effect". This effect is the same as the effect of rendering the potential holding layer 19 to be an electrode and applying a predetermined voltage to the electrode. The use of this self-bias effect of the present invention further makes it possible to prevent generation of leak, etc. due to application of the bias voltage without necessity for a bias power source, wiring therefor, and control means to be accompanied therewith. Furthermore, this self-bias effect of the present invention has the function of maintaining the potential holding layer 19 at a definite potential level, and absorbing excessive corona in the vicinity of the screen opening, which has been blocked from passage, hence it also has the effect of the conventional screen of a type with its electrically conductive member being exposed outside.

Further observations will be made as to the self-bias function. In general, the charge by the corona ion is determined by electrostatic capacitance Ci, electrical resistance Ri, discharge resistance of air Ro, and an applied voltage Vo. With these factors, the potential Vi existing on the insulative layer by the charging after lapse of a time t is usually represented as follows.

$$\frac{Ri}{Ri + Ro} Vo\left\{1 - \exp\left(-t/\frac{RiRo}{Ri + Ro} \cdot Ci\right)\right\} \quad (2)$$

Figure 13:
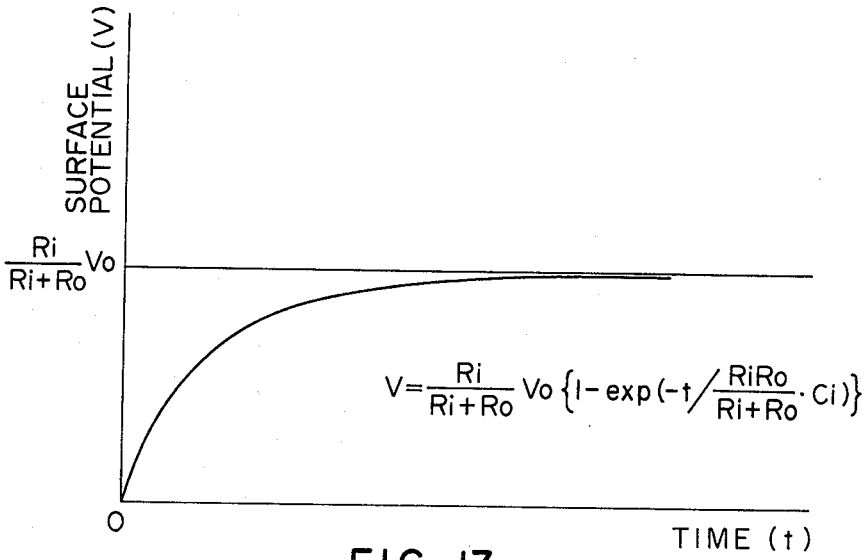
FIG. 13 is a graphical representation showing a relationship between the charging time and the potential affected by the layer thickness.

This relationship is illustrated by a graph in FIG. 13, wherein the abscissa represents a time, and the ordinate indicates the surface potential due to charging. As is apparent from the graph, the curve depends upon a time constant which is a product of the electrostatic capacitance and the resistance, provided that, after lapse of a certain time period, the potential becomes constant. Accordingly, the self-bias effect is governed by the resistance value of the potential holding layer, i.e., the higher the resistance value is, the higher becomes possible the potential bias setting. In general, the electrical resistance of the potential holding layer depends on the layer thickness, whereby the electrical resistance becomes higher as the layer thickness increases. Accordingly, the charge potential increases, and the electrostatic contrast of the primary latent image can be agumented.

Moreover, a rising time until the potential holding layer is charged and brought to a potential level which is considered constant is determined by the time constant RC of the potential holding layer, i.e., the greater the time constant RC is, the longer becomes the time until the potential holding layer attains a predetermined potential level. Therefore, when the time constant RC is too large, there occurs such a phenomenon that, until the potential holding layer reaches the above-mentioned potential level, the quantity of the corona ion current passing through the screen at the time of the modulation gradually increases. Therefore, in order that the potential holding layer may be charged to a potential level which can be considered constant within a certain time period, it is preferable that the potential holding layer has appropriate values of the electrical resistance and the time constant. It has been known from experiments that, in the case of a particular insulative material, the abovementioned time constant RC takes a constant value, if the material used is identical; however, in the insulative thin film constituting the potential holding layer, the time constant RC of the potential holding layer depends on the layer thickness, and increases as the layer thickness increases. It is therefore necessary that the layer thickness is kept less than a certain definite thickness so as not to increase the value of the time constant RC.

For the abovementioned reasons, in order that the potential holding layer may possess sufficient self-bias effect and reach a constant potential within a certain time period, its thickness should be limited to an appropriate value.

The potential holding layer according to the present invention is formed in such a way that its resistance value may range from $10^7$ to $10^{10}$ $cm^2$-ohm, or preferably from $10^8$ to $10^9$ $cm^2$-ohm in terms of a product of the volume resistivity of the material used and the thickness of the potential holding layer, and that its time constant may be 100 sec. or below, or preferably 50 sec. or below, whereby the self-bias effect of the potential holding layer can be utilized in the most effective state including its charge potential and charging speed. The material for use in the potential holding layer may be those having low volume resistivity which cannot be utilized generally as the insulative material. The above given range of the numerical figures are those under the applied electric field at the actual image formation with the layer thickness formed as the potential holding layer.

Further details of the potential holding layer will be given hereinbelow. This potential holding layer should possess the self-bias effect, i.e., the characteristic, by which the layer has a predetermined constant potential by the corona ion current at the time of the modulation. On account of this, even when the insulative material is simply provided at the side of the modulating corona source as is the case with the conventional screen, there take place various undesirable situations such that the charge potential considerably increases to break the potential balance between the front and rear surfaces of the screen, and that the modulating ion is further charged on the potential holding layer at the time of the modulation. As the result, the excessive charge turns around to the non-modulated side of the screen to thereby destroy the latent image formed, which does not construct the present invention.

Also, a simple insulative material has no function of absorbing the excessive corona ion at the time of the modulation.

In the following, explanations will be given as to the rate of opening (or open area ratio) of the screen according to the present invention so that it may be used in the optimum conditions. Incidentally, the term "rate of opening of the screen" as used herein is found from a ratio of the area of the screen openings to the total area of the screen (unit of measurement=%).

Figure 14:
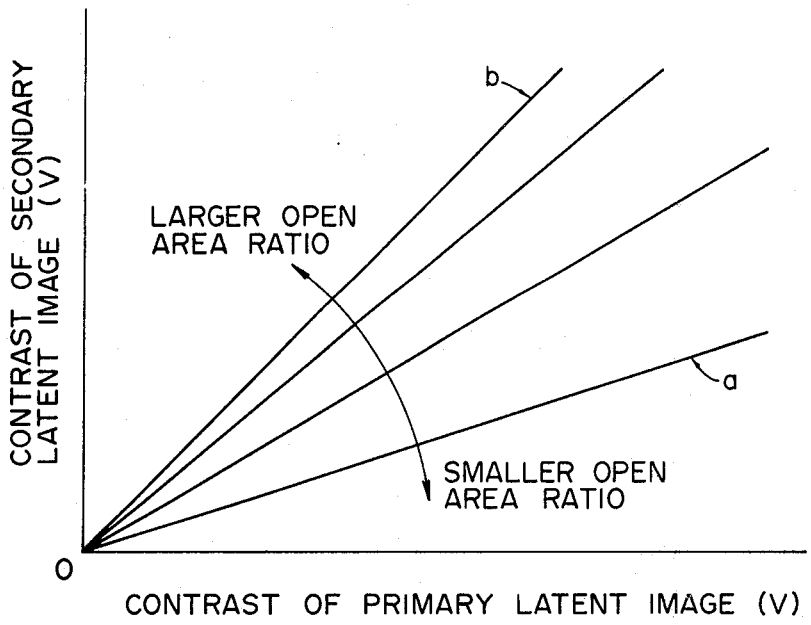
FIG. 14 is a graphical representation showing a relationship between the primary latent image contrast and the secondary latent image contrast depending on the rate of screen opening.

As the characteristic of the corona ion current passing through the openings of the screen, its passing quantity is determined by the rate of opening of the screen and the surface potential of the screen, on which the primary latent image is formed. The passing ion current quantity has such a tendency that it increases as the surface potential becomes high, and as the rate of opening of the screen becomes high in proportion to the surface potential. FIG. 14 is a graphical representation showing a relationship between the primary and second electrostatic latent image contrast relative to the abovementioned rate of screen opening, wherein the abscissa denotes the electrostatic contrast at the bright and dark portions of the primary latent image, and the ordinate represents the electrostatic contrast of the secondary latent image. Each of the rectilinear lines in the graph indicates the screen having arbitrary rate of opening, and increase in inclination from the line a to b denotes the increasing rate of opening. As is apparent from the above graph, when the electrostatic contrast of the primary latent image on the screen is made constant, the electrostatic contrast of the secondary latent image can be made higher with the screen having the higher rate of screen opening, although the surface potential of the screen tends to be lower as the rate of opening becomes higher.

Figure 2:
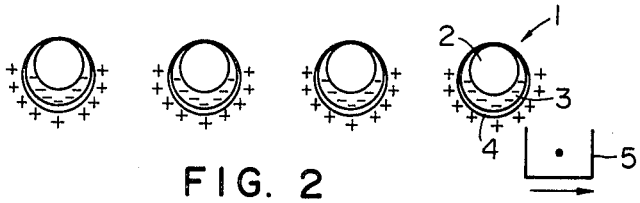
FIGS. 2 to 5 are explanatory diagrams for the latent image forming steps using the screen shown in FIG. 1.
Figure 3:
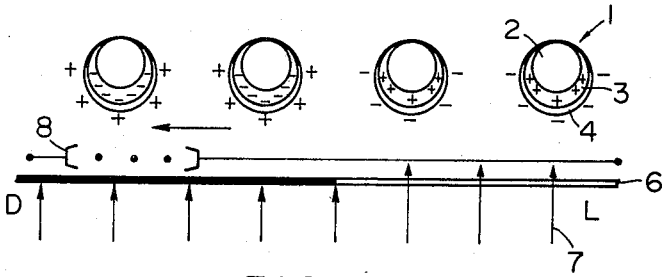
Figure 4:
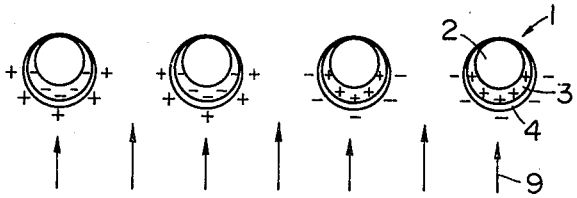
Figure 5:
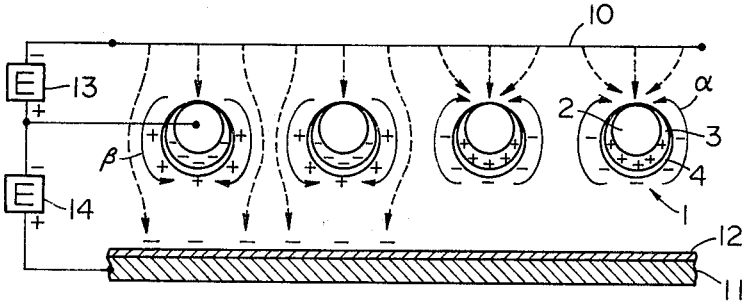
Figure 6:
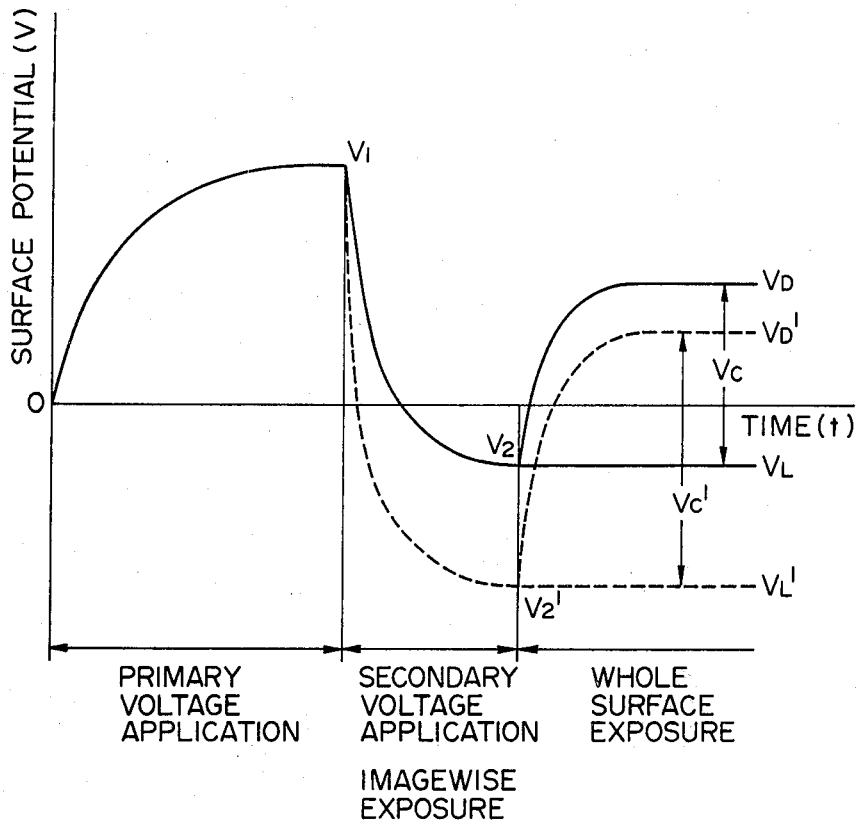
FIGS. 6 and 7 respectively indicate surface potential curves of the screens to compare the conventional technique with the present invention.
Figure 15:
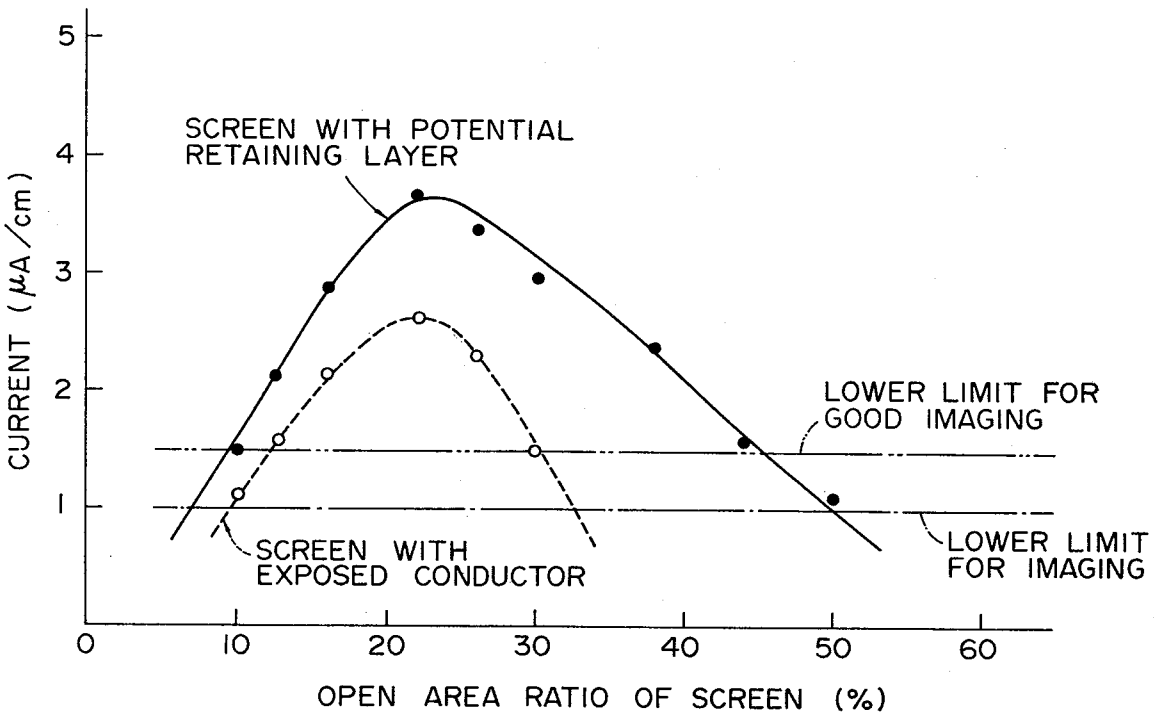
FIG. 15 is also a graphical representation showing a relationship between the rate of screen opening and the passing current quantity.

FIG. 15 is a graphical representation showing a relationship between the rate of screen opening in the screens shown in FIGS. 2 and 8 and the passing current quantity, wherein the abscissa denotes the rate of opening and the ordinate represents the passing current quantity at the ion passing side of the screen. In the drawing, the dash line curve shows a case of the conventional type screen, and the solid line curve shows a case of the screen having the potential holding layer according to the present invention. The conditions imposed on the experimental device, by which this graphical representation has been drawn are as follows: (1) the primary latent image forming processes have been done in accordance with FIGS. 2 to 4; (2) the primary voltage application value is made identical for both screens, and the secondary voltage application value is made larger only to the screen of the present invention (solid line side); and (3) the modulating corona application value is made same for both screens.

From the analyses of the graph, it will be understood that the modulating effect is clearly different due to difference in the screen construction. The point of difference is such that, as stated in regard to FIG. 7, the primary latent image of the screen according to the present invention is capable of remarkably increasing the electrostatic contrast between the bright and dark portions in comparison with the primary latent image of the exposure type. As the result of this the passing quantity of the ion through the screen having the same rate of opening as the exposed type screen can be made large as stated in FIG. 14. That is, the dash line showing the rate of opening in the conventional exposed type screen and the passing current quantity is improved to a state shown by the solid line in the screen according to the present invention.

In the screen process, it is desirable that the rate of opening of the screen to be used is in a preferable range, since the rate of screen opening constitutes the governing factor to set the passing quantity of the ion as mentioned in the foregoing. The standard for setting this range may be as follows: (1) in order to obtain the final image by developing the secondary latent image in a satisfactory image quality, the electrostatic contrast of the secondary latent image should be higher than a certain definite value; (2) while it is contemplated that the insulative layer of the chargeable surface for the secondary latent image formation is made thick to increase the electrostatic capacitance and to maintain the secondary latent image at a high potential level, when the insulative layer is made thick as such, the image quality becomes actually lowered, hence it is necessary to increase the contrast of the secondary latent image by passing the ion current in a sufficient quantity; (3) when the modulating corona ion is considerably increased in quantity, discharge readily takes place between the corona wire and the screen (or the chargeable surface), and excessive corona ion destroys the primary latent image to deteriorate the retention characteristics; and other reasons.

Generally, in order to obtain an image by modulation, 1 $\mu$A/cm or so is necessary as the passing current quantity of the ion. For obtaining further sufficient image quality, the passing current quantity should be 1.5 $\mu$A/cm or more. Accordingly, in the exposed type screen, the rate of opening of the screen ranges from 10 to 32%, or more preferably from 12 to 30% or so, while, in the screen according to the present invention, it may range from 5 to 50%, or more preferably from 10 to 45%.

As stated above, the screen having the potential holding layer is capable of remarkably increasing the primary latent image contrast in comparison with the conventional exposed type screen with the consequence that the passing quantity of the ion current can be increased, and, at the same time, the rate of screen opening can be set in a broad range. On account of this, it is highly advantageous in stabilizing various characteristics of the screen, stabilizing its manufacture, and saving the material used.

The primary latent image forming process to obtain the abovementioned self-bias effect is realized in the sequences as mentioned in the foregoing. To reiterate, it consists of:

(a) the primary voltage application step by the corona discharge in a particular polarity;
(b) the secondary voltage application step by the corona discharge in the polarity opposite to that in the image irradiation and the primary voltage application step;
(c) the overall irradiation step.

In the following, another example of the primary latent image forming steps in the latent image forming process using such screen will be explained, wherein the abovementioned self-bias effect is effectively utilized. The screen used is that shown in FIG. 8, and the state of moving of the charge in each forming step is similar to the above-described process, hence detailed explanations will be dispensed with.

Figure 16:
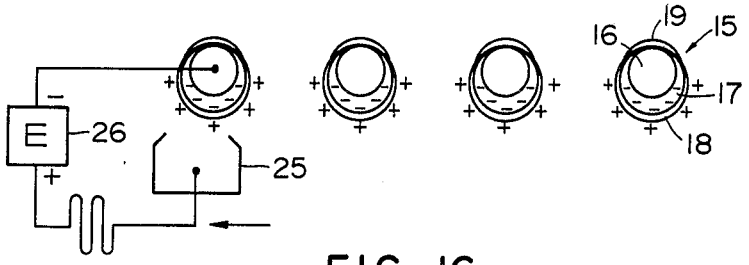
FIGS. 16 to 19 are explanatory diagrams for the latent image forming steps of the present invention.
Figure 17:
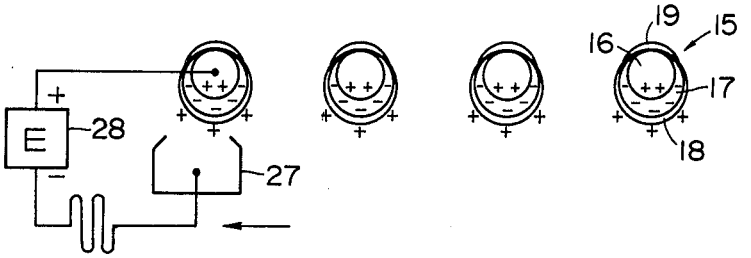
Figure 18:
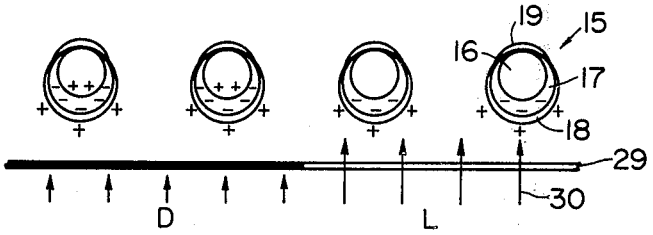
Figure 19:
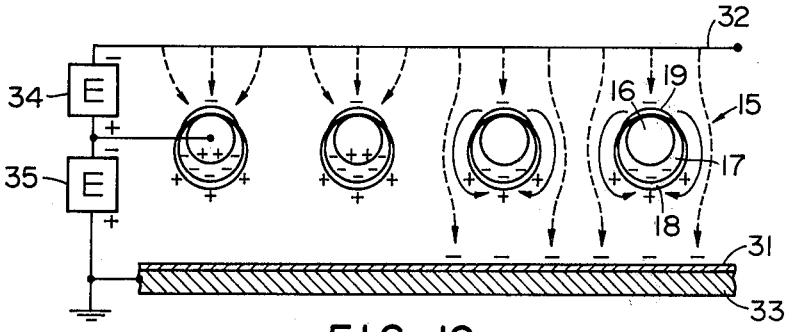

FIGS. 16 to 19 are explanatory diagrams showing the second example of the latent image formation, in which FIG. 16 shows the primary voltage application step to the screen 15, wherein the surface insulative layer 18 is uniformly charged to the positive polarity by the corona discharger 25. A reference numeral 26 designates a power source for the discharger. By this electric charging, the surface of the surface insulative layer 18 is charged to the positive polarity, and the neighboring area of the surface insulative layer 18 in the photoconductive layer has a negative charge layer which is opposite to the first charge polarity. FIG. 17 shows a result of the secondary voltage application step given to the screen 15 which has been subjected to the primary voltage application step. In this step, a voltage of the power source 28 for the discharger 27 is adjusted so that the surface potential of the surface insulative layer 19 may assume Vcrit. With the negative corona ion current. FIG. 18 shows a result of carrying out the image irradiation to the screen 15 which has been subjected to the above process steps. In the drawing, a reference numeral 29 designate an original image, a reference letter D designates a dark portion of the original image, L a bright portion thereof, arrow marks 30 indicate light rays for image irradiation. By the image irradiation, the potential at the bright portion on the screen 15 changes to a potential proportionate to the charge quantity on the surface of the surface insulative layer 18, although no potential change occurs at the dark portion thereof. As the result, there is formed on the screen 15 the primary latent image following the original image. FIG. 19 shows a state, in which the secondary electrostatic latent image is formed on the chargeable surface 31 by the primary latent image on the screen 15. In the drawing, a reference numeral 32 designates a corona wire and 33 an electrode. The electrode 33 functions as the opposite electrode to the corona wire 32. The corona wire 32 is applied with a negative voltage from the power sources 34, 35, and the electrode 33 is held at the zero potential. In this step, the principle of modulation of the ion current is the same as mentioned above, and, since the negative corona ion current is caused to pass through a portion of the screen corresponding to the bright portion of the original image, this portion becomes a negatives image against the positive original image when it is developed with a positively charged color developing particles (toner). Incidentally, when an appropriate bias voltage is applied to the electrode 33 or the development electrode, and the development is carried out with a negatively charged color development particles, there can be obtained a positive image contrary to the above case.

Figure 20:
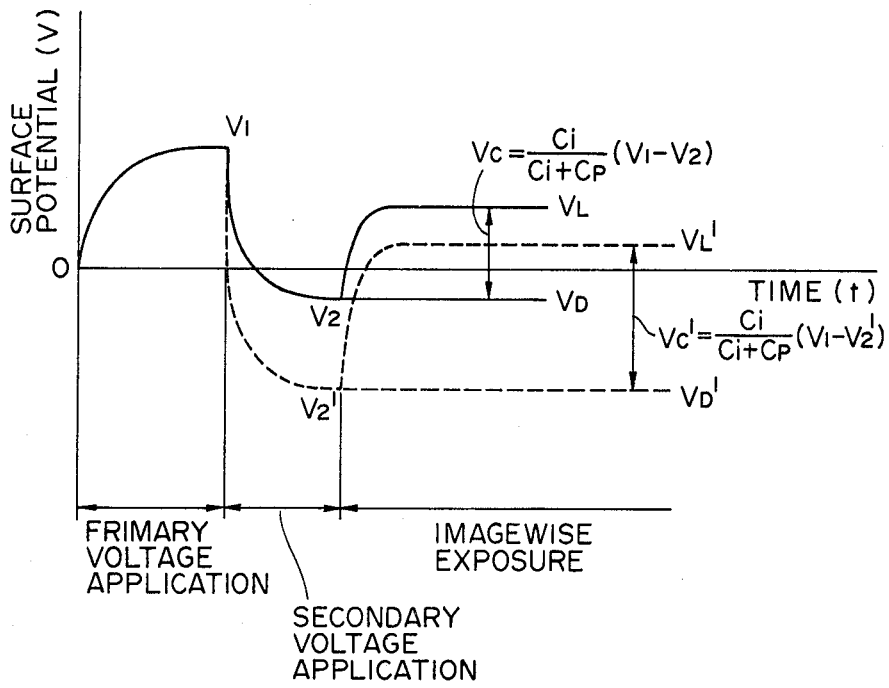
FIG. 20 shows a surface potential curve of the screen in each step shown in FIGS. 16 to 19 above.

FIG. 20 is a surface potential curve showing variations in the surface potential on the screen 15 in each step shown in FIGS. 16 to 18. In the graph, the solid line curve indicates the surface potential of the screen not provided with the potential holding layer 19, while the dash line curve indicates the surface potential of the screen provided with the potential holding layer according to the present invention. The potentials $V_D$, $V_D'$ take the critical value of Vcrit. in the secondary latent image forming step with the result that the electrostatic contrast can be expanded from Vc ($V_D$, $V_L$) to Vc' ($V_D'$, $V_L'$). The other examples of the steps, to which the present invention is applicable, are the primary voltage application step to be performed on the abovementioned screen, the secondary voltage application step subsequent to the primary voltage application step, the image irradiation step following the secondary voltage application step, the tertiary voltage application step, and the overall irradiation step after the tertiary voltage application step, all of these steps constituting the primary latent image forming process. In the following, the latent image forming process will be explained in reference to FIGS. 21 to 26.

Figure 21:
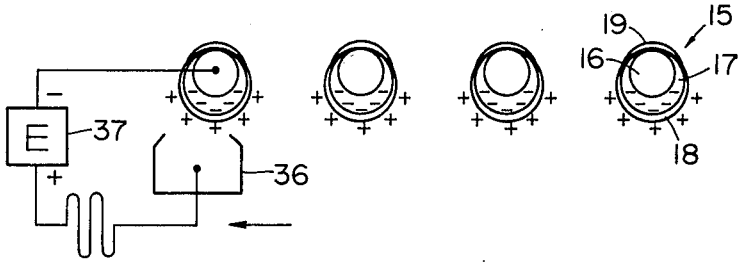
FIGS. 21 to 26 are explanatory diagrams for another embodiment of the latent image forming steps according to the present invention.
Figure 22:
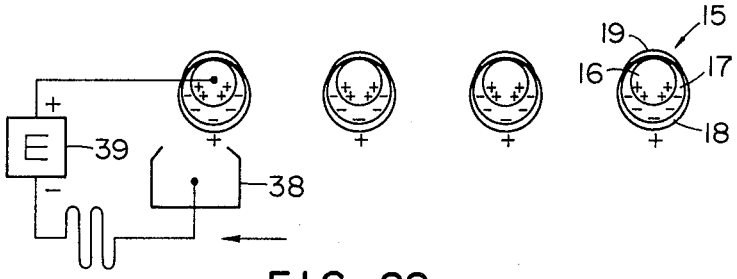
Figure 23:
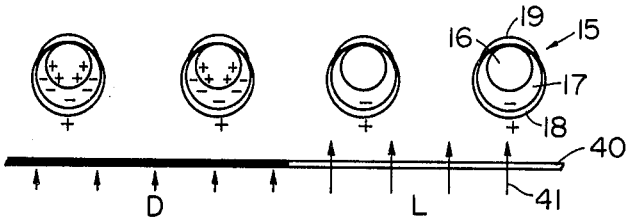
Figure 24:
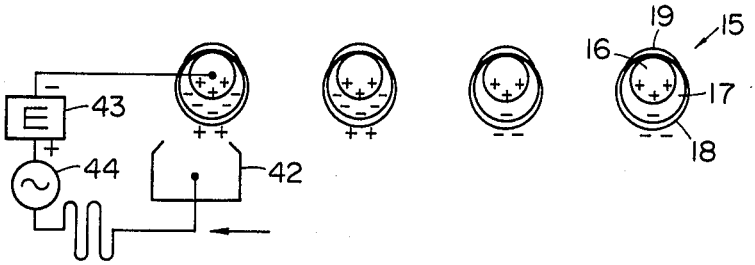
Figure 25:
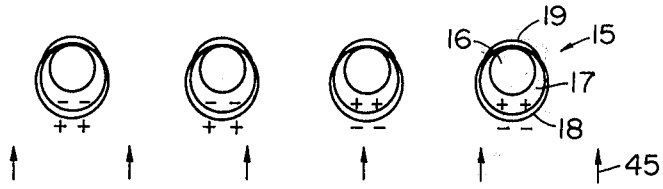

FIG. 21 shows the primary voltage application step, wherein the surface insulative layer 18 is positively charged by the corona discharger 36. In this case, if the photoconductive layer 17 is made of a material which does not exhibit the rectification property, an arrangement of the electric charge as shown in the drawing can be obtained by effecting the overall light irradiation onto this photoconductive layer 17 at the time of the primary voltage application. FIG. 22 shows the secondary voltage application step, wherein the screen 15 has been subjected, in the dark, to the voltage application in the opposite polarity to that of the primary voltage application. By this secondary voltage application, a part of the charge on the surface insulative layer 18 is extinguished, but the charge layer in the photoconductive layer 17 does not show any change. In the drawing, a reference numerals 36, 38 designates the corona discharger, and 37, 39 power sources for the respective dischargers. A reference numeral 40 designates an image original, and arrows 41 denote light rays. In this step, no change takes place in the charge at the dark portion in the photoconductive layer; however, in the bright portion, there takes place such phenomena that the holes are injected from the electrically conductive member 16, and the electrons trapped in the photoconductive layer 17 are photo-excited to flow out into the electrically conductive member 16. As the result, there is formed a charge-couple at the bright portion with the surface insulative layer 18 being interposed between them. FIG. 24 shows the tertiary voltage application step, in which the voltage application is done by the corona discharge in the same polarity as that in the secondary voltage application. By the negative voltage application or a.c. voltage application, on which the negative voltage is superposed, the surface potential at the dark portion on the screen 15 is small in its change, while the surface potential at the bright portion thereon resumes the negative polarity. In the drawing, a numeral 42 refers to a corona discharger, 43 a negative power source, and 44 an a.c. power source. FIG. 25 illustrates the overall irradiation step, by which the surface potential at the bright portion on the screen assumes the negative polarity, while a positive primary latent image is formed on the dark portion. In the drawing, the arrows marks 45 denote light rays. The primary latent image is not extinguished even at the bright portion.

Figure 26:
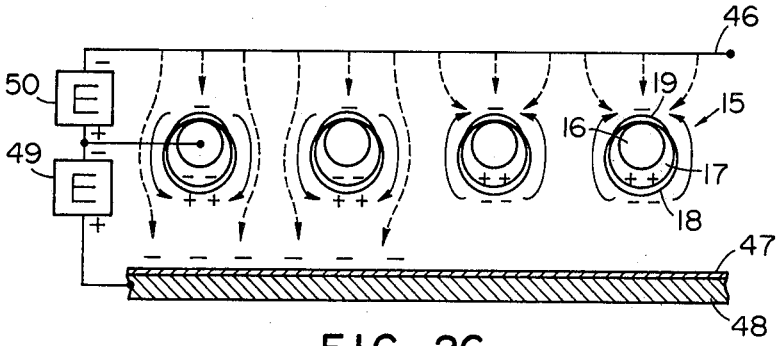

FIG. 26 shows the secondary latent image forming process. The principle of modulation accompanying the self-bias effect is dispensed with, as it has already been explained in the foregoing. In the drawing, a reference numeral 46 designates the corona wire, to which a potential in the polarity opposite to that of the surface potential at the dark portion is applied. A numeral 47 refers to the chargeable surface the opposite electrode 48, 49 a power source for the bias field provided between the opposite electrode 48 and the screen 15, and 50 a power source for the corona wire 46. Dash lines denote the flow of corona ion from the corona wire 46. In order that the surface potential of the primary latent image on the bright portion shown in FIG. 25 formed at the modulating step in the primary latent image forming process may take the critical value of Vcrit. with respect to the negative corona ion current in the secondary latent image formation shown in FIG. 26, the voltages at the abovementioned power sources 39, 43 and 44 are adjusted so as to set the surface potential at an arbitrary level. Since, in the present embodiment, the corona ion current is caused to pass through a part of the screen corresponding to the dark portion of the original image, a positive image can be obtained when the latent image is developed with a positively charged color developing particles (toner).

Figure 27:
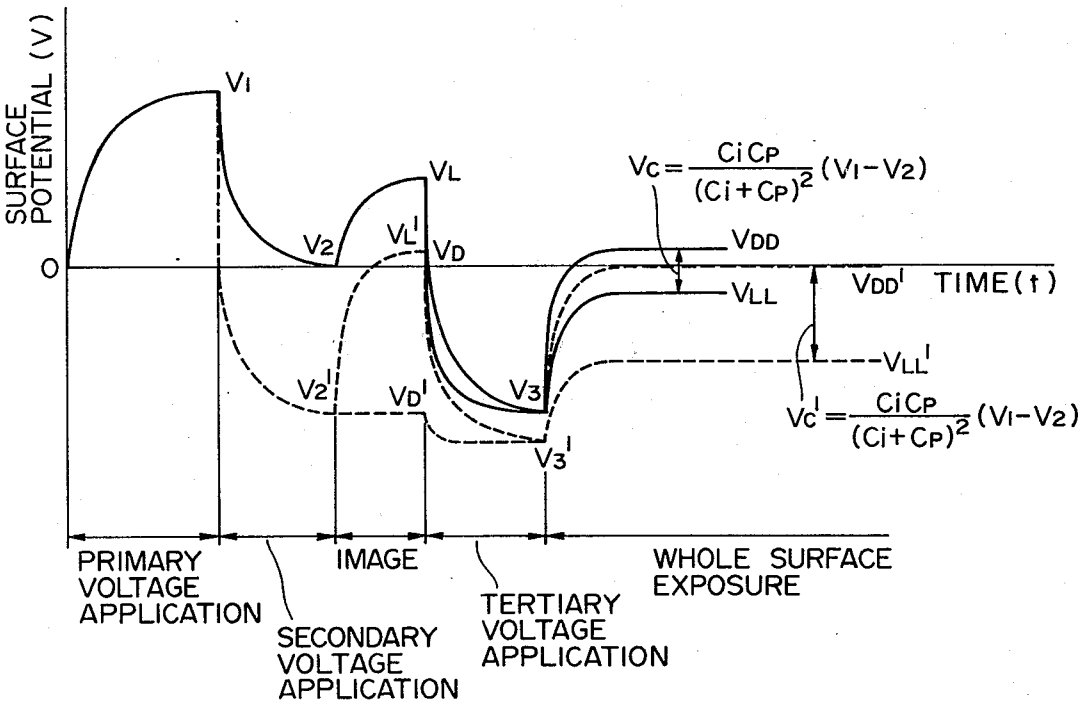
FIG. 27 shows a surface potential curve of the screen in each step shown in FIGS. 23 to 25.

FIG. 27 is a surface potential curve indicating variations in the surface potential on the screen 15 in each of the process steps shown in FIGS. 21 to 25. In the drawing, the solid line curve denote the surface potential of the screen not provided with the potential holding layer, and the dash line curve denotes the surface potential of the screen according to the present invention provided with the potential holding layer. As is the case with FIG. 20, $V_{LL}$ and $V'_{LL}$ constitute the potential Vcrit. to determined the blocking field at the time of the modulation.

In the above explanation, there has been shown an example, wherein the modulating corona ion is used as the means for making the potential on the potential holding layer constant. It is also possible to provide an exclusive corona charger for charging the potential holding layer.

In the following, the other examples of the screen which exhibits the self-bias effect to be obtained by charging the potential holding layer with a predetermined voltage through application of the corona ion in the same manner as in the screen shown in FIG. 8 will be given. FIGS. 28 through 38 inclusive illustrate enlarged crosssections of such embodimental screens.

Figure 28:
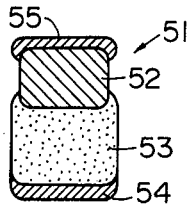
FIGS. 28 to 40 respectively show enlarged cross-sections of the screens, to which the present invention is applicable.

The screen 51 shown in FIG. 28 is of such construction that the photoconductive layer 53 is provided on the electrically conductive member 52, and the surface insulative layer 54 is further formed on the photoconductive layer 53. The potential holding layer 55 is provided on the electrically conductive member 52 at the side opposite that of the photoconductive layer 53. In this case, the surface insulative layer 54 is not necessarily required to cover the entire photoconductive layer 54, but it may cover the same in a manner such that a part of the lateral surface of the layer 54 be exposed. Also, the potential holding layer 55 provided on the rear surface side of the electrically conductive member 15 is not required to cover the entire rear surface side, but a part of the electrically conductive member (substrate) may be exposed outside.

Figure 29:
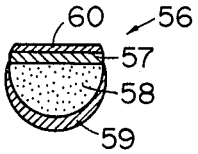

The screen 56 shown in FIG. 29 is of such construction that the photoconductive layer 58 is provided on the thin electrically conductive member 57, then the surface insulative layer 59 is coated over this photoconductive layer 58 in a manner to cover the entire surface thereof, and the potential holding layer 60 is provided on the electrically conductive member 57 at the side opposite to the photoconductive layer 58. In this instance, since the electrically conductive member 57 is thin in its thickness, the charge to be adhered onto the lateral surface of the electrically conductive member is negligible, hence a strong electric field can be formed.

Figure 30:
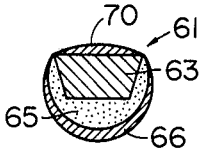
Figure 31:
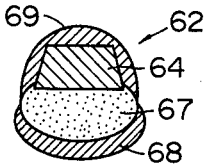

The screens 61, 62 shown in FIGS. 30 and 31, respectively, are formed by etching the electrically conductive members 63, 64, the cross-section of which is in a trapezoidal shape. The screen 61 of FIG. 30 has the photoconductive layer 65 and the surface insulative layer 66 provided on the surface side where the area of the opening is larger than the other, which makes it possible to form the opening in a larger size at the time of forming the photoconductive layer 65. On the contrary, the screen 62 shown in FIG. 31 has the photoconductive layer 67 and the surface insulative layer 68 provided on the surface side where the area of the opening is smaller than the other, which makes it possible to neglect the charge to be adhered onto the lateral surface of the electrically conductive member as is the case with the screen construction shown in FIG. 29. The potential holding layer 69 formed on the opposite side of the electrically conductive member andd the photoconductive layer changes its thickness smoothly from the center of the electrically conductive member 64 toward the opening as compare with the potential holding layer 70 in FIG. 30, and the potential varies in continuity from the center part toward the opening at the time of charge adherence for the self-bias, hence the bias effect works more effectively.

Figure 32:
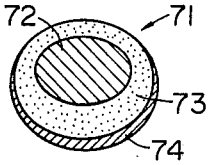

The screen 71 in FIG. 32 is formed in such a manner that the photoconductive layer 73 is coated on the electrically conductive member 72 in a manner to cover the whole circumference, and the surface insulative layer 74 is coated on one side alone of the photoconductive layer 74. In this case, the photoconductive layer 73 exposed at the modulating side constitutes the potential holding layer to exhibit the self-bias effect although, at the time of the modulation, as the photoconductive layer is used as the insulative layer, the modulation is effected at the dark portion of the screen.

Figure 33:
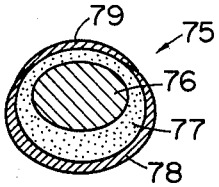

The screen 75 shown in FIG. 33 is of such construction that, same as the screen 71 of FIG. 32, the photoconductive layer 77 is formed in a manner to completely cover the electrically conductive member 76, then the surface insulative layer 78 is formed on one side surface of the photoconductive layer 77, and the potential holding layer 79 is formed on the exposed surface side of the electrically conductive member 76 where the modulating corona is applied. The screen of this construction requires appropriate degree of light irradiation from the side of the potential holding layer 79 or the other side, because the photoconductive layer 77 is required to be rendered electrically conductive at its modulating side, particularly, during the secondary latent image formation. Incidentally, the potential holding layer 79 may be so formed that the surface insulative layer 78 be coated on the modulating corona side at its formation, and the modulating side of this continuous surface insulative layer 78 be made the potential holding layer.

Figure 34:
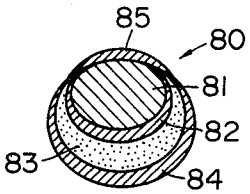

The screen 80 shown in FIG. 34 is of such construction that the first insulating layer 82 is provided on one side surface of the electrically conductive member 81, then the photoconductive layer 83 is coated on this first insulating layer 82, the second insulating layer 84 is further formed on the photoconductive layer 83, and the potential holding layer 85 is formed on the electrically conductive member 81 at the side of the modulating corona source. The potential holding layer 85 may also be formed even when these first and second insulating layers 82, 84 cover this side of the modulating ion source at the time of their formation. In the screen of this construction, the light irradiation may well be done, in particular, at the time of the primary voltage application in the course of applying the corona discharge for the primary latent image formation.

Figure 35:
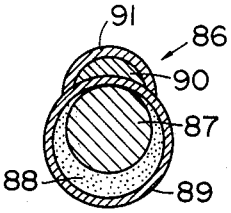

The screen 86 shown in FIG. 35 is of such construction that the photoconductive layer 88 is provided on one surface side of the electrically conductive member 87, then the surface insulative layer 89 is provided in a manner to cover the entire circumference of the electrically conductive member 87 and the photoconductive layer 88, thereafter a layer 90 composed of an electrically conductive material is further formed on the other surface side of the electrically conductive member, and finally the potential holding layer 91 is formed on the layer 90. The electrically conductive member 87 and the electrically conductive layer (potential holding layer) 91 are electrically connected.

Figure 36:
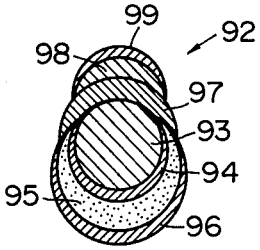

The screen 92 shown in FIG. 36 is of such construction that the first insulating layer 94 is provided on one surface side of the electrically conductive member 93, then the photoconductive layer 95 is formed on this first insulating layer 94 in a manner not to adhere onto the other surface side of the electrically conductive member, the second insulating layer 96 is similarly formed on the photoconductive layer in a manner not to adhere onto the electrically conductive member 93 at the other surface side thereof, thereafter a layer 97 consisting of an insulating material is coated on the exposed portion of the electrically conductive member 93, on which a layer 98 consisting of an electrically conductive material is further coated, and finally the potential holding layer 99 is formed on this layer 98. The insulating layer 97 may be formed in a manner to entirely cover the first or second insulating layer 94 or 96 at the time of its formation. The electrically conductive member 93 and the electrically conductive layer 98 are electrically connected. The screen of this construction is subjected to the light irradiation to its photoconductive layer 95 at the time of the primary voltage application as is the case with the screen in FIG. 34.

Figure 37:
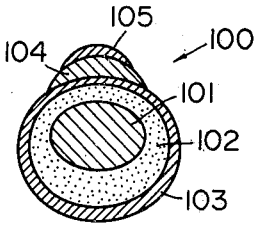

The screen 100 shown in FIG. 37 is of such construction that the photoconductive layer 102 is provided in a manner to cover the electrically conductive member 101, then the surface insulative layer 103 is formed on this photoconductive layer 102 in a manner to cover the layer entirely, thereafter a layer 104 consisting of an electrically conductive material is formed on one surface side of the surface insulative layer 103, and finally the potential holding layer 105 is formed on this electrically conductive layer 104. In this case, the electrically conductive member 101 and the electrically conductive layer 104 are electrically connected. As is the case with the screen of FIG. 33, the screen of the above construction is required to be light-irradiated at the time of the secondary latent image formation, from the side where the potential holding layer 105 exists.

Figure 38:
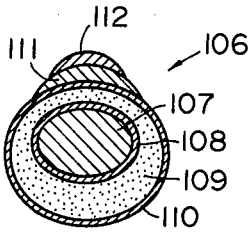

The screen 106 shown in FIG.38 is of the same construction as that shown in FIG. 37 with the exception that the first insulating layer 108 is provided to cover the electrically conductive member 107. Same as the screen of FIG. 36, this screen is subjected to the light irradiation at the time of the primary voltage application for the primary latent image formation. In the drawing, a reference numeral 109 designates the photoconductive layer, 110 the surface insulative layer, 111 the electrically conductive layer, and 112 the potential holding layer.

Figure 39:
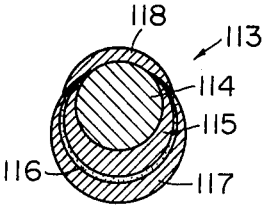

The screen 113 shown in FIG. 39 is of such construction that the first insulating layer 115 is provided on one surface side of the electrically conductive member 114, then the thin photoconductive layer 116 is coated on the first insulating layer 115 in electrical connection with the electrically conductive member 114, thereafter the surface insulative layer 117 is coated on this thin photoconductive layer 116 in such a manner that the other surface side of the electrically conductive member 114 may be exposed, and finally the potential holding layer 118 is formed on this exposed surface side of the electrically conductive member 114. The screen is basically the same as that shown in FIG. 34. The point of difference from the FIG. 34 screen is that the photoconductive layer 116 is thin and the electrostatic capacitance is sufficiently large in comparison with the first insulating layer 115. The electrostatic contrast to be obtained by the abovementioned screen 113 can be obtained by substituting the electrostatic capacitance of the first insulating layer for the electrostatic capacitance of the photoconductive layer in the equation (1).

In the following, examples of the image formation using the above-described screens having the self-bias effect will be presented.

EXAMPLE 1

In the fabrication of the screen according to the present invention, use is made of a base plate (or substrate), as the electrically conductive member, having 250 mesh size which is made of nickel alloy wire of 30 microns in diameter manufactured by the electroforming method. Onto this electrically conductive member, there is coated the photoconductive layer by spraying a solution, which is prepared by mixing the cadmium sulfide (CdS) powder generally used as the photosensitive member for electrophotography and a normal-temperature setting type silicon resin as a binder at a rate of 30% by weight, from one surface side of the electrically conductive member in a manner not to close the openings in the above-mentioned electrically conductive member. The spray-coating is done in such a manner that the maximum thickness of the photoconductive layer may be approximately 25 microns. Thereafter, the spray-coated liquid is dried and hardened. After this, a liquid resin same as that of the abovementioned binder is spray-coated onto this photoconductive layer in a manner not to clog the openings and to yield the maximum thickness of approximately 3 microns, thereby forming the surface insulative layer. In the formation of the abovementioned each layer, a part of the electrically conductive member is exposed at the modulating side. Subsequent to formation of the surface insulative layer, the potential holding layer is formed by spray-coating the resin material same as the abovementioned binder onto this exposed surface part of the electrically conductive member to a film thickness of 0.4 micron, followed by drying and hardening the same. In the formation of the potential holding layer, a part of the surface insulative layer is adhered onto the exposed surface part of the electrically conductive member by selection of appropriate conditions, whereby simultaneous formation of the surface insulative layer and the potential holding layer becomes possible.

The thus fabricated screen is charged with ±300 volts by the primary voltage application step. Subsequently, it is subjected to the image irradiation with an exposure light quantity of 8 lux/sec., and almost simultaneously to electric charging in the opposite polarity by the negative corona discharging, followed by the overall irradiation. As the result of this, the primary electrostatic latent image is formed on the surface insulative layer of the screen. In confrontation to the thus formed primary electrostatic image surface, there is placed an electrostatic recording paper as the chargeable surface at a space interval of 2 mm. While maintaining the potential on this recording paper at a level of +3 KV with respect to the electrically conductive member of the screen, the negative corona discharge is performed onto the recording paper through the primary latent image formed on the screen. At this time, the corona wire applies a voltage of −4 KV or so to the electrically conductive member, and operates at a speed of 40 cm/sec. or so with respect to the screen, whereby the corona ion current is modulated by the primary latent image and the secondary electrostatic latent image is formed on the recording paper.

In the above-described steps, the strength of the secondary voltage is adjusted in such a way that passage of the corona ion current through the bright portion of the image on the screen may be completely blocked. As stated above, the electrostatic contrast between the dark and bright portions on the screen provided with the potential holding layer can be made large by intensifying the secondary voltage and, at the same time, utilizing the self-bias effect of the potential holding layer. The following Table 1 indicates comparison of the surface potential of the primary latent image formed on the screen having the potential holding layer fabricated in the above-described method and that on the screen not having such potential layer.

TABLE 1

| | Comparison of Surface Potential of Primary Latent Image | |
|---|---|---|
| | Screen without potential holding layer | Screen with potential holding layer |
| Bright portion of image ($V_L$ and Vc) | −57 V | −227 V |
| Dark portion of image ($V_D$) | +133 V | +87 V |
| Primary electrostatic latent image contrast | 190 V | 314 V |

It is apparent from the above Table 1 that the screen of the present invention is able to augment the electrostatic contrast by 1.5 times or higher than that in the conventional screen.

Next, the recording paper bearing thereon the secondary latent image is developed by the liquid developing method using positively charged color development particles. As the result, there can be obtained a reproduced image having high image resolution and the intermediate tone faithful the original image. Further, in utilization of the primary latent image on the screen according to the present invention, the retention copying was performed consecutively for 100 times from one and the same primary latent image. It is found out that, in the case of using the screen not having the potential holding layer, there was observed slight lowering in the image density and the 100th sheet of the reproduced image, while, in the case of using the screen having the potential holding layer of the present invention, the image density did not lower even at the 100th sheet of the reproduced image, i.e., it was as equal as the first sheet.

EXAMPLE 2

In this example, the primary latent image is formed by the primary voltage application step which applies the primary voltage to the screen, the secondary voltage application step subsequent to the first step, and the image irradiation step following the second step. The screen used is of the same construction as used in Example 1 above.

First, the screen is charged with a voltage of +300 V in the primary voltage application step. Subsequently, the negative corona discharge is given to the screen followed by the image irradiation with the light irradiating quantity of 8 lux/sec., thereby obtaining the primary latent image on the surface insulative layer of the screen. Using the thus formed primary latent image, there is obtained the secondary latent image in the same manner as described in Example 1 above. In this instance, the conditions for the secondary voltage in the primary latent image forming process are so adjusted that passage of the corona ion current may be perfectly blocked at the portion corresponding to the bright portion of the image on the screen.

The following Table 2 indicates comparison of the surface potential of the primary latent image formed on the screen having the potential holding layer according to the present invention and that on the screen having no such potential holding layer.

TABLE 2

| | Comparison of Surface Potential of Primary Latent Image | |
|---|---|---|
| | Screen without potential holding layer | Screen with potential holding layer |
| Bright portion of image ($V_L$ and Vc) | −55 V | −210 V |
| Dark portion of image ($V_D$) | +125 V | +85 V |
| Primary electrostatic latent image contrast | 180 V | 295 V |

Same as in the above Example 1, the electrostatic contrast increased remarkably.

Nest, the recording paper having thereon the secondary latent image was developed by the liquid developing method using the positively charged color development particles. A clear, negative reproduced image resulted. Further, there was performed the retention copying for consecutive 100 times using the screen having thereon the thus formed primary latent image. It was found out that, in the case of using the screen not having the potential holding layer, there was observed slight lowering in the image density in the 100th sheet of the reproduced image, while, in the case of using the screen having the potential holding layer of the present invention, there was obtained clear reproduced image which is substantially same with the first sheet of the reproduced image in its image density.

EXAMPLE 3

In this third example, the primary latent image is formed by the primary voltage application step which applies the primary voltage to the screen, the secondary voltage application step subsequent to the primary voltage application step, the image irradiation step followed by the third voltage application step, and the overall irradiation step. The screen used is of the same construction as used in Example 1 above.

First, the screen is charged uniformly with a voltage of +300 volts in the primary voltage application step. Subsequently, the negative corona discharge is given to the screen followed by the image irradiation with the irradiating light quantity of 8 lux/sec., followed by further negative corona discharging, and the final overall irradiation. As the result of this, the primary latent image is obtained on the surface insulative layer of the screen. Using the thus formed primary latent image, the secondary latent image is obtained by the same method as in Example 1 above. In this instance, the voltage for the secondary and tertiary voltage application steps in the latent image forming process are so adjusted that passage of the corona ion current may be perfectly hindered at the bright portion of the image on the screen.

The following Table 3 indicates comparison of the surface potential of the primary latent image formed on the screen having the potential holding layer according to the present invention and that on the screen having no such potential holding layer.

TABLE 3

| | Comparison of Surface Potential of Primary Latent Image | |
|---|---|---|
| | Screen without potential holding layer | Screen with potential holding layer |
| Bright portion of image ($V_L$ and Vc) | −54 V | −154 V |
| Dark portion of image ($V_D$) | +23 V | +3 V |
| Primary electrostatic latent image contrast | 77 V | 157 V |

Same as Example 1 above, the electrostatic contrast increased remakably.

Figure 40:
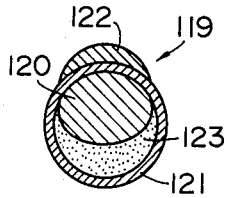

In the foregoing description, the example of the screen according to the present invention have been shown, wherein the corona ion from the corona discharger is used for bringing the potential holding layer to a predetermined potential level. For the other method, there is such one that, using the screen 119 shown in FIG. 40, a voltage is applied between the electrically conductive member 120 and the electrically conductive layer 122 at the side of the corona ion source across the insulating layer 121. In the drawing, a numeral 123 refers to the photoconductive layer which may be formed as shown in FIG. 37. With this method, the secondary latent image is formed by applying, after the primary latent image formation, a negative bias voltage to the electrically conductive layer 122 and the electrically conductive member 120 to modulate the corona ion. At this time, the critical value Vcrit. shifts to the negative side for the abovementioned bias voltage, whereby there can be obtained an effect same as the abovementioned self-bias effect. However, in the method of applying the bias voltage to the electrically conductive layer, there is practical necessity for providing a bias power source and an electric control means, hence the device tends to become complicated.

What we claim is:

1. A photosensitive screen member for use in an electrophotographic method wherein an image is formed by modulating an ion current by an electric field formed in the photosensitive screen body, said screen body comprising an electrically conductive member having a multitude of fine openings; a photoconductive layer on said electrically conductive member; a surface insulative layer constituting a surface of the photosensitive member on the side opposite to a source of modulating corona ions for holding thereon a latent image charge; and an electric potential holding layer provided on the surface of said photosensitive member on the modulating corona source side for maintaining a surface potential of a predetermined value during a modulation operation, wherein the predetermined value is sufficient to form, at the portion of said screen where the flow of ions is to be blocked, a potential difference between the surface potential of said insulating layer and the surface potential of said potential holding layer which is sufficient to block the passage of ions at least through the associated openings.

2. The photosensitive screen member according to claim 1, wherein said surface insulative layer and potential holding layer are separately constructed.

3. The photosensitive screen member according to claim 1, wherein said surface insulative layer and potential holding layer are integrally constructed.

4. The photosensitive screen member according to claim 1, wherein said photoconductive layer inside said surface insulative layer extends to the modulating corona source side to form said potential holding layer.

5. The photosensitive screen member according to claim 1, wherein the electric resistance of said potential holding layer is selected within a range of from $10^7$ to $10^{10}$ $cm^2$—ohm in terms of the product of the volume resistivity of the material used and the thickness of the potential holding layer.

6. The photosensitive screen member according to claim 1, wherein a time constant of said potential holding layer is set at 100 seconds or less.

7. The screen photosensitive member according to claim 1, wherein the open area in said photosensitive screen member ranges from 5 to 50%.

8. The screen photosensitive member according to claim 7, wherein the open area in said photosensitive screen member ranges particularly from 10 to 45%.

9. An electrophotographic method for forming an image on a chargeable surface by modulation of ion current by an electric field formed on a photosensitive screen member which is essentially constructed with an electrically conductive member having a multitude of fine openings, a photoconductive layer provided on said electrically conductive member, a surface insulative layer constituting a surface of said photosensitive member on the side opposite to a modulating corona ion source for holding a latent image charge thereon, and an electric potential holding layer provided on the surface of the photosensitive member on the modulating corona source side for maintaining a surface potential of a predetermined value during a modulation operation, wherein the predetermined value is sufficient to form, at the portion of said screen where the flow of ions is to be blocked, a potential difference between the surface potential of the insulating layer and the surface potential of the holding layer which is sufficient to block the passage of ions at least through the associated openings, said electrophotographic method comprising:

forming a primary latent image on said photosensitive member by at least the steps of:

(a) uniformly charging said surface insulating layer to a particular polarity;

(b) irradiating bright and dark patterns of an image on said photosensitive member; and (c) uniformly charging said photosensitive member to a polarity opposite to the charge polarity in step (a), said charging step being effected either simultaneously with, or subsequent to, said step (b):

subsequently applying said modulating corona ion current from the side of said potential holding layer, while maintaining said potential holding layer at the predetermined electric potential; and forming an image on the chargeable surface due to the modulated corona ion current.

10. The electrophotographic method according to claim 9, wherein said potential holding layer is maintained at the predetermined electric potential by application of the modulating corona ion current so that corona ions may be charged on said potential holding layer.

11. The electrophotographic method according to claim 9, wherein said potential holding layer is maintained at the predetermined electric potential by application of a bias voltage to said potential holding layer.

12. In an electrophotographic method for forming an image by modulation of ion current by an electric field formed on a photosensitive screen member which is essentially constructed with an electrically conductive member having a multitude of fine openings, a photoconductive layer provided on said electrically conductive member, a surface insulative layer constituting a surface of the photosensitive member on the side opposite to a modulating corona ion source for holding a latent image thereon, and an electric potential holding layer provided on the surface of the photosensitive member at the modulating corona source side for maintaining a surface potential of a predetermined value during a modulating operation, the predetermined value being sufficient to form, at a portion of the screen where the flow of ions is to be blocked, a potential difference between the surface potential of the insulating layer and the surface potential of the holding layer which is sufficient to block the passage of ions at least through the associated openings, the steps of: regulating the passage of ion current at the openings in said photosensitive member with a first electric field caused by a potential difference between the electric charge on said surface insulative layer and an electric charge on said potential holding layer which has been automatically charged to the predetermined potential at the time of modulation creating a second electric field between said screen photosensitive member and said modulating ion source for directing the ion current to said photosensitive screen member and creating a third electric field between said photosensitive screen member and a chargeable surface for directing said ion current, the passage of which is regulated at said openings, to said chargeable surface.

13. The photosensitive screen member according to claim 5, wherein the electric resistance of said potential holding layer is selected within a range of from $10^8$ to $10^9$ $cm^2$—ohm.

14. The photosensitive screen member according to claim 6, wherein the time constant of said potential holding layer is set at 50 seconds or less.

* * * * *

UNITED STATES PATENT OFFICE

CERTIFICATE OF CORRECTION

Patent No. 4,308,331 Dated December 29, 1981

Inventor(s) NOBORU NARITA, ET AL.

It is certified that error appears in the above-identified patent and that said Letters Patent are hereby corrected as shown below:

Column 1, line 34, "imge" should read --image--;
line 45, after "effect" insert --,--.

Column 2, line 27, "carrier" should read --carriers--;
line 35, "result" should read --results--;
line 43, "number" should read --numeral--;
line 61, "therof" should read --thereof--.

Column 3, line 20, "exist" should read --exists--.
line 56, "increases" should read --increased--.

Column 9, line 48, "hundreds" should read --hundred--.

Column 18, line 7, "determined" should read --determine--.

Signed and Sealed this

***Twenty-second* Day of *June 1982***

[SEAL]

*Attest:*

GERALD J. MOSSINGHOFF

*Attesting Officer* *Commissioner of Patents and Trademarks*